United States Patent [19]

Bodenan et al.

[11] Patent Number: 4,575,952

[45] Date of Patent: Mar. 18, 1986

[54] HOT AIR DRYER STRUCTURE

[75] Inventors: Rene Bodenan, Ballancourt/Essonne; Nicholas Teculescu, Meudon, both of France

[73] Assignee: M.E.G., S.A., Morangis, France

[21] Appl. No.: 649,601

[22] Filed: Sep. 12, 1984

Related U.S. Application Data

[63] Continuation-in-part of Ser. No. 303,488, Sep. 18, 1981, abandoned.

[51] Int. Cl.[4] ..... F26B 13/20

[52] U.S. Cl. ..... 34/54; 34/155; 34/156; 34/160; 34/242; 432/242

[58] Field of Search ..... 432/242, 18, 186, 199; 34/155, 156, 160, 242, 212–217, 54

[56] References Cited

U.S. PATENT DOCUMENTS

| | | | |
|---|---|---|---|
| 1,595,486 | 8/1926 | Minton | 34/156 |
| 3,827,639 | 8/1974 | Relue et al. | 34/156 |
| 4,133,636 | 1/1979 | Flynn | 432/72 |
| 4,268,977 | 5/1981 | Geiger | 34/242 |
| 4,326,342 | 4/1982 | Schregenberger | 34/212 |

*Primary Examiner*—Larry I. Schwartz

*Attorney, Agent, or Firm*—Cynthia Berlow; Mitchell D. Bittman

[57] ABSTRACT

A modular hot air dryer includes air jet support for a continuously moving, freshly printed flexible paper web. Air curtains are provided at the dryer entrance and exists to prevent excess fresh air penetration into the dryer. Air which is intentionally introduced is preheated before being introduced through the air curtains to help avoid tar build-up. Automatic control is provided of the exhaust flow rate to maintain constant vapor concentration. Each zone of the dryer is separately temperature-controlled.

41 Claims, 9 Drawing Figures

HOT AIR DRYER STRUCTURE

RELATED APPLICATIONS

This application is a continuation-in-part of co-pending application Ser. No. 303,488, filed Sept. 18, 1981 now abandoned in the names of Bodenan and Teculescu.

BACKGROUND OF THE INVENTION

This invention relates to hot air dryers, and more particularly to dryers with simultaneous support for continuous webs of flexible material previously treated with a vaporizable material such as ink.

Webs of printed paper coming from an offset press line are commonly dried by hot air dryers which evaporate the solvents of the deposited ink. Hot air dryers are known, which compress a housing within which are disposed, between spaced web inlet and outlet openings, two rows of nozzles disposed respectively above and below the plane of movement of the web. These nozzles define air ejection slits which extend transversely to the direction of movement of the web and which face the web to be dried. The nozzles of the upper set are offset relative to those of the lower set to create undulations in the longitudinal direction of the web. These cancel out transverse undulations which tend to be produced under the effect of the web tension. The nozzles are connected to at least one recycling fan and a source of heat. The housing also contains an exhaust fan.

Due to this arrangement, the substances to be evaporated, for example, the solvents of printing inks, are quickly removed due to intensive thermal exchange. The jets of hot air emitted by the slits of the nozzles also ensure continuous support of the web between the inlet and outlet openings, avoiding any contact of the web with the components of the apparatus. Such contact could cause, for example, tearing of the web or smearing of wet ink in the case of a web of printed paper.

Webs from offset printers move at speeds which are frequently 5 to 10 meters per second, and the hot air is blown at a temperature of 150° C. to 300° C. Consequently, the web of paper is heated to 120° C. to 160° C., and it is also desirable to cool it before cutting and folding.

Apparatus of this kind is shown in U.S. Pat. No. 3,739,491, in which the housing is a single piece over the whole length of the apparatus and contains a single, asymmetrically disposed source of hot air. Certain disadvantages exist in drying apparatus of this kind which operate at high speed, for example, 10 meters per second.

Thus, the concentration of substances, such as solvents and other componenents of the ink, becomes high and their dew point rises (from 40° C. up to 70° C.) so that condensation occurs at the drying air inlets. This can produce spots on the web, or even block nozzle openings, producing a loss of web support, which can shut down the dryer and an entire printing line.

Essentially, the cold external air which enters the web inlet and outlet openings forms a source of condensation-like mist as it meets the hot air, laden with solvent and rising from the web. Moreover, when drying a printed web on a given apparatus, the quantity of solvent varies very considerably and can reach a ratio of 1 to 100, depending on the solvent. Therefore, in some cases, the concentration of solvent is too high and produces undesirable condensation, even though a constant pressure drop is maintained, by controlling the rate of exhaust of used air as a function of this pressure drop. That is, careful regulation of the passage drop may not prevent condensation in the case of very high concentrations of solvent.

Furthermore, in certain drying lines, an increase in running speed of the web requires drying apparatus of greater length because then they are more economical and consume less energy than short drying tunnels. There is a limit to maximum length, however, because the support structure for the nozzles at operating temperatures which can reach 300° C. does not have sufficient mechanical strength to resist twisting and bending under the effect of the thermal stresses.

In certain other known apparatus, the fan and burner are disposed beneath and above the drying zone with the fan downstream of the burner, and connected to the nozzles by a wedge-shaped chamber. This structure has the disadvantage that, if the flame blows through (because of a drop in air pressure or an increase in gas pressure), it can reach and damage or destroy the fan. Furthermore, since the fan pressure is related to air density and thus to its temperature, which can vary from 120° C. to 330° C., significant pressure variations can occur which are unfavorable to uniform web support pressure and adequate support of the web.

Finally, the thermal energy consumption of known dryers is very high, because of the high flow rates of exhaust air. This also requires the use of large upstream cleaners which also consume substantial energy. The high exhaust flow rate is due particularly to the entry of cold air through the inlet and outlet openings in the envelope housing, which cannot be reduced without risk of blocking the flow of recycled air which is laden with solvents.

As for the construction of the housing, apparatus is known which has a main envelope which contains only the nozzles and the means for exhausting used air. The fan and burner, which constitute the means for reheating the air supply, are then placed in a separate envelope disposed adjacent the first envelope and connected to it by connection sleeves. This arrangement is difficult to adapt to the available space offered for a given installation, and prevents extension of the apparatus if required by an increase of the web speed. In general, installations with two drying tunnels "in line" and even touching, had the perceived disadvantage of not ensuring equal spacing of the nozzles at the interface zone, and consequent reduced reliability for the web support.

BRIEF DESCRIPTION OF THE PRESENT INVENTION

The present invention provides a housing or envelope which comprises at least two separate sections which are fixed together. Each section comprises two respective rows of nozzles and a respective recycling fan whose input communicates with the inside volume of its respective envelope and whose output is connected to respective rows of nozzles through ducts connected to a source of heat.

Due to this modular arrangement, the overall housing can have any desired length to accommodate high web speeds now required in modern offset printing apparatus. For example, 7-meter long housings can be made. Thus, two or three or more sections can be stacked together since the sections are practically identical, except for those which may carry a common source of heat or a common exhaust fan. It follows that the length of each section can be limited to a suitable value, for example in the order of 2.5 to 3.0 meters. As the width of the dryer is increased, a larger number of sections is used to reduce the flow rate to be produced by each recycling fan. This subdivision of the envelope reduces the thermal stress on the nozzle supports and guarantees suitable mechanical strength at the nozzles. The subdivision also improves the uniformity of nozzle air flow and of temperature distribution by enabling a regular spacing of the nozzles connected to the recycling fan of each section.

It is particularly advantageous to set the distance between the last nozzle of one section and the first nozzle of the next section equal to the distance between the nozzles of a given section. This ensures a constant spacing of the nozzles from one end to the other of the envelope and avoids any interruption in the support of the web, and prevents flapping of the web as it passes from one section to the next.

In a preferred embodiment of the invention, one end section of the entire envelope contains a burner which is associated with a combustion chamber. The burner is disposed at the inlet end of a combustion chamber which receives recycled air from the output of a recycling fan. The inlet is situated upstream of the heat adding means for said ducts. This arrangement enables a mixture to be obtained in two stages. First, there is dilution of the burner gas with air coming directly from the recycling fan associated with this burner. Second, there is dilution with air sent by the same fan directly to the blower ducts, which gives greater flexibility in regulating temperature and pressure, and produces a more uniform temperature. Moreover, the positioning of the passages adding heat to the blower ducts downstream of the recycling fan avoids possible damage or destruction of the fan.

Preferably, the heat source is common to at least two modular sections. The temperature of the air arriving at the nozzles of each section is independently controlled by control of the heat added to each of the sections. For example, valves consisting of variable angle flaps can be disposed in the passages adding heat to the blower ducts of at least one of the sections of the envelope to enable regulation of the flow of heated gas from the combustion chamber going to the different sections. This enables production of different temperatures in the different sections, and thus provides a desired temperature profile for the moving web within the oven. The flaps can be controlled manually or automatically. In the latter case, the flaps of one section can be connected to an automatic regulator device, itself connected to temperature sensors disposed in that section and in an adjacent section.

In one embodiment of the invention, the nozzles of a given section of the envelope are split into at least two groups which are connected to the recycled mixture of air and combustion gas. Each section can be separated, by means of partitions, into at least two parts, a control flap being operated between the two parts to enable blower temperatures which are different and controllable in the different parts of the same section.

Preferably, the exhaust fan is situated inside the envelope of the apparatus, in which case only its drive motor is disposed outside the housing. This avoids having to provide a special drive motor support frame on the envelope, and eliminates the connecting ducts which would be heat insulated, and, above all, deadens the noise of the fan.

In particularly advantageous fashion, each of the web inlet and outlet openings in the envelope is provided with two nozzles which are placed respectively above and below the web path and which define air ejection slits extending transversely relative to the direction of web movement and across the whole width of the web. These nozzles are connected to a source of pre-heated air which is external to the envelope of the apparatus. The nozzles form curtains of air which block the entry of outside air through the inlet and outlet openings. The air for these air curtains is taken from outside the envelope and preheated, which eliminates the risk of condensation within the envelope and also reduces the required exhaust flow. Preferably, the upper and lower nozzles of each of the inlet and outlet openings can each define two slits laterally spaced apart in the direction of web movement, the space between the upper slits being offset and partially overlapping the space between the lower slits.

This arrangement creates an additional node in the path of the web at the inlet or outlet of the envelope, thus stabilizing further the web at its entry into the envelope. Moreover, the creation of this additional node adjacent the inlet or outlet opening, reduces the play of the web in the opening, so that the height of the opening can be minimized. This reduces the flow of external air into the envelope or housing through the web inlets and outlets since this flow is a function of the cross-sectional area of the opening and of the difference in air pressure between the inside and the outside of the housing.

Conveniently, the external air source can comprise a fan, which also supplies the combustion air of the heat source. This avoids the need for an additional air source and reduces energy consumption since, in normal operation, the burner only works at approximately one-third of its power. Its maximum power is used only during warm-up of the apparatus. Note that there is no disadvantage in having a lower air pressure in the inlet and outlet nozzles during warm-up since no solvent is present then which might produce condensation.

The pre-heating means preferably comprise a heat exchanger situated in the combustion chamber of the burner of the apparatus to avoid the need for an additional source of pre-heat. Thus, the pre-heating means can be arranged to recover heat from either or both the heated but dried web and the air (purified or unpurified) coming out of the exhaust fan.

The external air source and the heat recovery system can be associated with a web cooler disposed at the output end of the drying apparatus. The fan for heated combustion air can, for example, take air in from the hood of the web cooler.

Preferably, the exhaust regulating fan flow is controlled by an automatic device in response to, the pressure difference between the inside and the outside of the envelope and the concentration of solvent within the dryer. This enables exhaust air flow to be reduced when the solvent concentration is low and increased when the concentration is high, to avoid the undesirable condensation referred to above. Solvent concentration can be measured indirectly and can be taken from the web speed, in the case of a press line, the concentration of oxygen in the envelope or the solvent concentration in the extracted air can be measured directly.

Preferably, the longitudinal members bearing the nozzles comprise tubes defining air flow orifices which communicate with said nozzles and are open at their ends, so that a small part of the air flow penetrates these longitudinal members to ensure their uniform temperature.

DETAILED DESCRIPTION OF THE DRAWINGS

Figure 1:
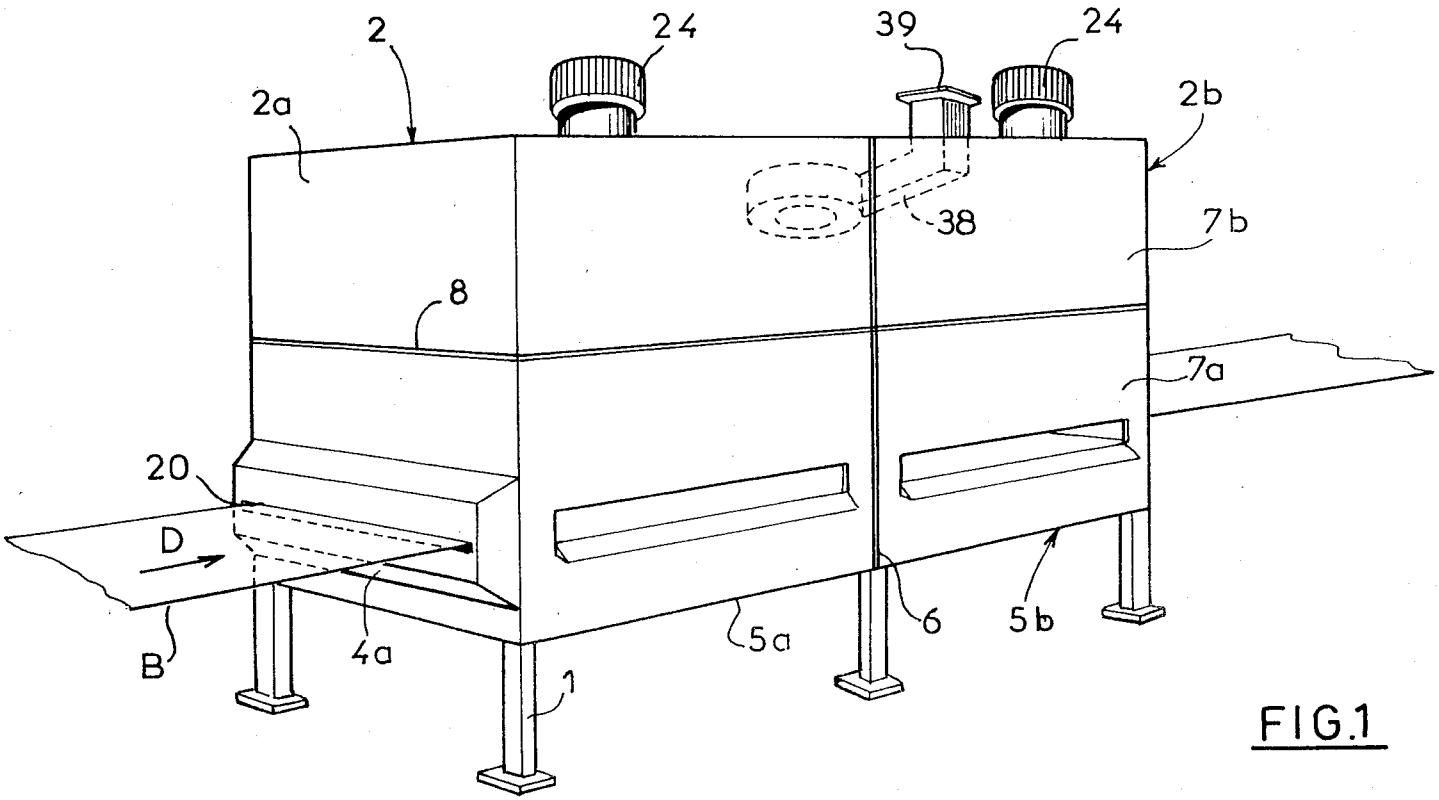
FIG. 1 is a perspective view of one embodiment of the dryer of the invention, consisting of two modular sections.

The apparatus of the invention is shown in the drawings as apparatus for drying webs of printed paper coming from an offset printing line. The apparatus, and the individual features to be described, can have other applications.

As shown in the figures, the dryer is mounted on support legs such as leg 1 (FIG. 1) and forms a closed envelope or casing 2 which has a generally parallelepiped shape, having two vertical sides 2*a* and 2*b*. Sides 2*a* and 2*b* contain inlet 3*a* and outlet 3*b* openings, respectively. A pair of nozzles 4*a* and 4*b* are fixed to the outer surfaces of sides 2*a* and 2*b*, adjacent the two openings 3*a* and 3*b*. A web to be dried moves through the dryer in a generally horizontal direction D from the inlet opening 3*a* towards the outlet opening 3*b*.

The envelope comprises two separate modular parallelepiped chambers 5*a* and 5*b* which are joined in a vertical plane 6 and are fixed together in this plane. Each of sections 5*a* and 5*b* contains two superposed chamber sections 7*a* and 7*b* (FIG. 1), the lower chamber 7*a* forming the blower chamber, while the upper chamber 7*b* forms a reheating chamber. Chambers 7*a* and 7*b* are joined in a horizontal plane 8.

Each of the blower chambers 7*a* of the two sections 5*a* and 5*b* contain two sets of nozzles 9*c* and 9*d* (FIGS. 2 and 4), disposed in two horizontal planes parallel to the mean plane of the web B and laterally spaced by a small distance from this plane, for example 3 to 4 millimeters. Each of the nozzles 9*c* and 9*d* comprises an elongated hollow bar, extending transversely to the direction D. Each of the nozzles 9*c* and 9*d* contain two spaced, parallel slits 10 which extend across the width of the web B. Each of the pairs of slits 10 are separated by a solid section and create an air cushion to support the web B. The air bars 9*c* above the web B alternate in the longitudinal direction D with an equal number of lower bars 9*d* and are laterally spaced from one another by an equal distance p.

The nozzles 9*c* and 9*d* are fixed to respective collectors or plenums 11*c* and 11*d*, respectively, which extend horizontally in the direction D. Collectors 11*c* and 11*d* communicate both with the air bars 9*c* and 9*d* and with communications ducts 12*c* and 12*d*, respectively. Ducts 12*c* and 12*d* are connected to the middle of collectors 11*c* and 11*d* lengthwise, respectively, although, for clarity, the junction of the lower duct 12*d* in FIG. 2 is shifted to the end of the collector.

Exactly the same arrangement as that described above is provided in the second section 5*b* of the envelope. Furthermore, the same pitch p which separates the nozzles of a given collector also separates the last nozzle 9*d* of the lower collector of the first section from the first nozzle of the upper collector of the second section, thus ensuring proper location of the air cushions along the full length of the dryer.

Figure 2:
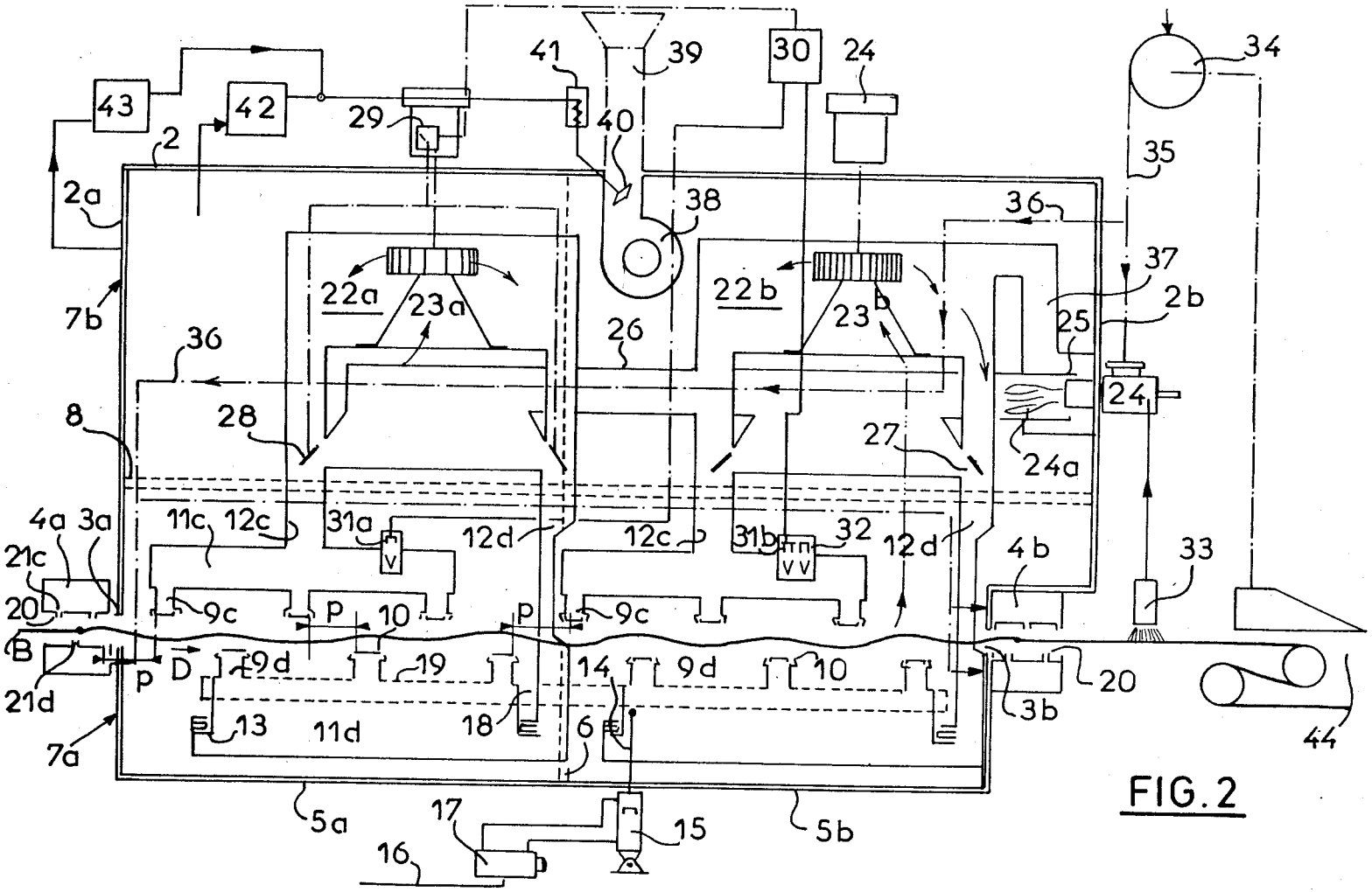
FIG. 2 is a schematic representation of FIG. 1 in a vertical section through the apparatus.

The lower collectors 11*d* of FIG. 2 are formed of two vertically telescoping, sliding parts with elastic seals 13 interposed between the shaped facing edges of the two component parts. The lower part of the lower collectors is fixed and the upper part, which carries the air bars 9*d*, can be displaced vertically by a push rod linkage 14 (FIG. 2). The linkage 14 is controlled by a jack 15 which is operated by compressed air from source 16, through a two-way valve 17. This enables the lower set of nozzles to be lowered, either when the apparatus is shut down, for example for maintenance, or during operation for any desired reason. The mechanism 14 supports the two longitudinal hollow tubular members 18 (FIG. 7) which are disposed laterally on the opposite sides of the collectors 11*d* and on which the nozzles 9*c* are fixed.

Figure 7:
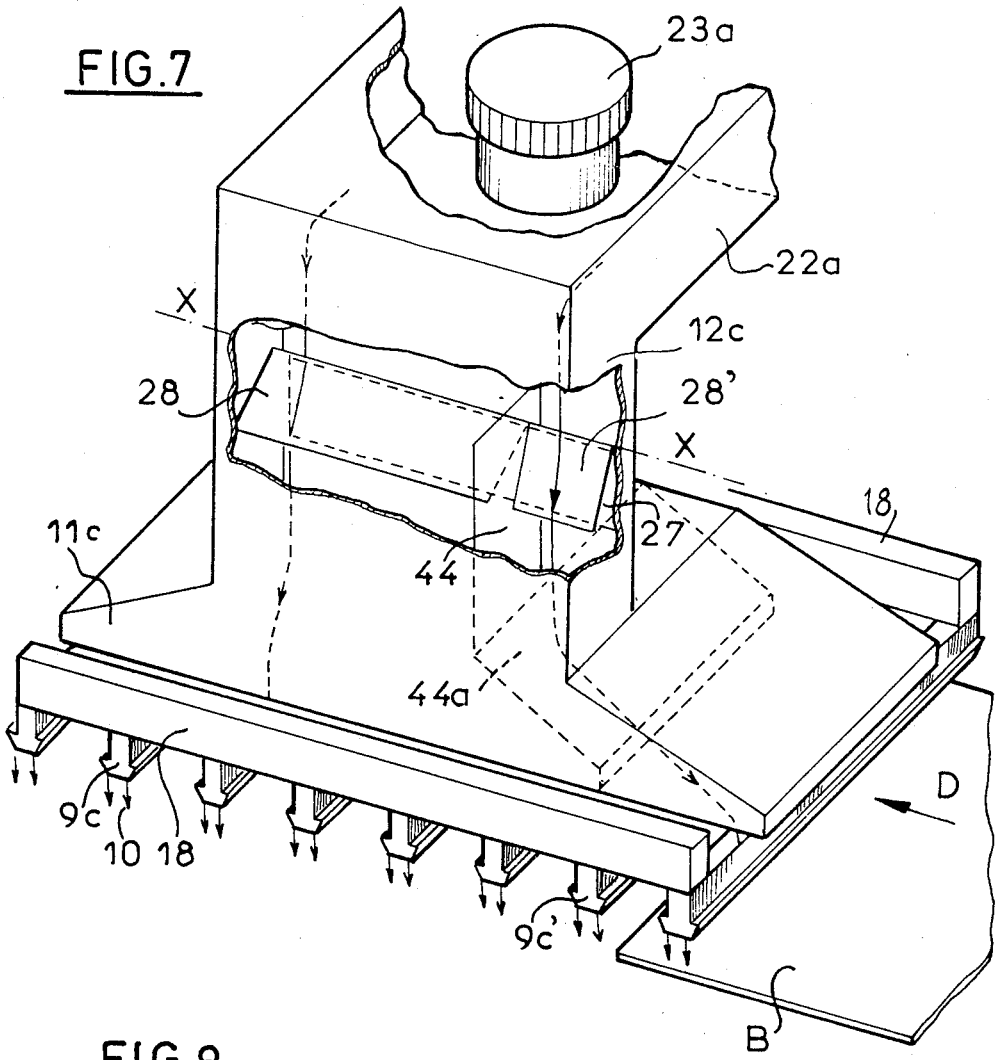
FIG. 7 is a perspective view of a blower according to one embodiment of the invention and a partition wall.
Figure 8:
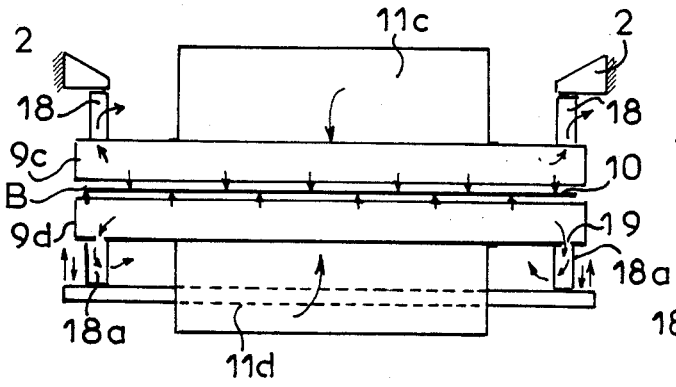
FIG. 8 is a schematic transverse section of the apparatus of the drawings, showing the web which passes therethrough.
Figure 9:
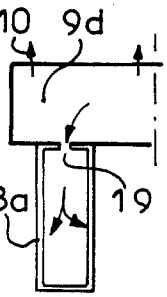
FIG. 9 is a detail of FIG. 8 and shows a further embodiment of the invention.

More specifically, as shown in FIGS. 7, 8 and 9, each of the air bars 9*c* which communicates with the upper collector or plenum 11*c* is also fixed and suspended at each of its two ends beneath one of the two hollow tubular members 18. Members 18 are in turn fixed to the envelope 2. Holes 19 are formed between members 18 and the air bars 9*c* to ensure that hot air enters members 18, which are also open at their ends. This circulation of air ensures a uniform temperature along the length of members 18. The same is true of the lower air bars 9*d*, which are fixed and carried in an exactly symmetrical fashion by hollow tubular members 18*a*, which can be displaced vertically using the mechanism 14. Holes 19 are also provided between the bars 9*d* and members 18*a* to ensure a similar circulation.

Figure 4:
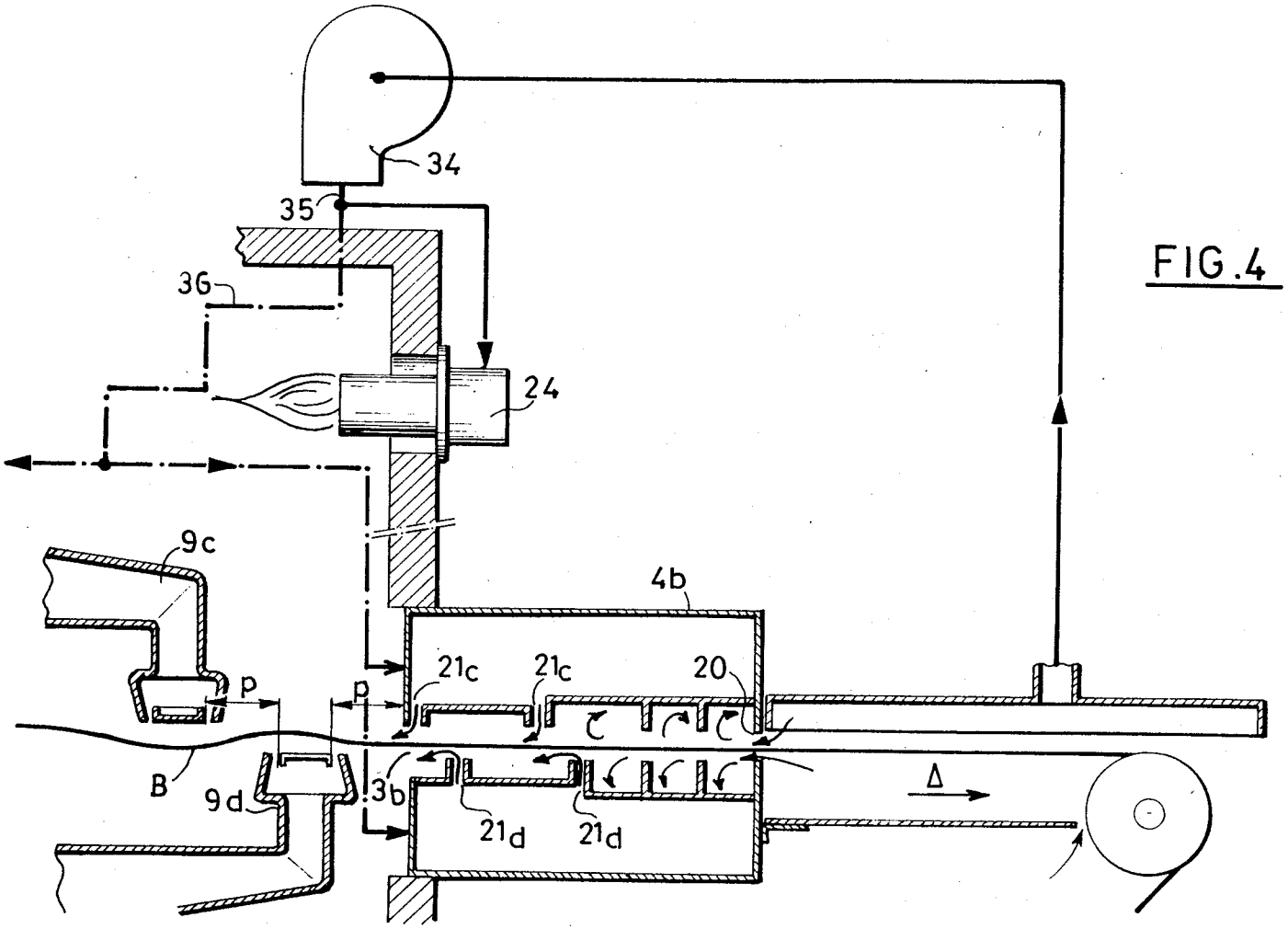
FIG. 4 is a cross-sectional diagram showing the structure of air curtains employed at both the inlet and outlet nozzles of the dryer of FIG. 1.

As shown in FIG. 4, each pair of nozzles at the inlet 4*a* and outlet 4*b* contains a horizontal passage 20 for the web B at the level of the inlet (3*a*) and outlet (3*b*) openings. Horizontal passages 20 contain nozzles consisting of two slits disposed transverse to the direction D on the upper and lower faces of the passage. Thus, upper slits 21*c* are disposed alternately with the two lower slits 21*d* along the horizontal direction D. Slits 21*c* and 21*d* are spaced from the web B by the same spacings used between the slits of the air bars 9*c* and 9*d*. The slit 21*d* or 21*c* of each nozzle closest to the end wall 2*a* or 2*b* of the envelope is positioned as close as possible to respective opening 3*a* or 3*b*. The air flowing out of each of the slits 21*c*, 21*d* forms a curtain of air which separates the gases within the envelope 2 from the external air. Moreover, since the slits are disposed in pairs on opposite sides of the web, air cushions are formed which maintain additional nodes of undulations in the path of web B.

Figure 5:
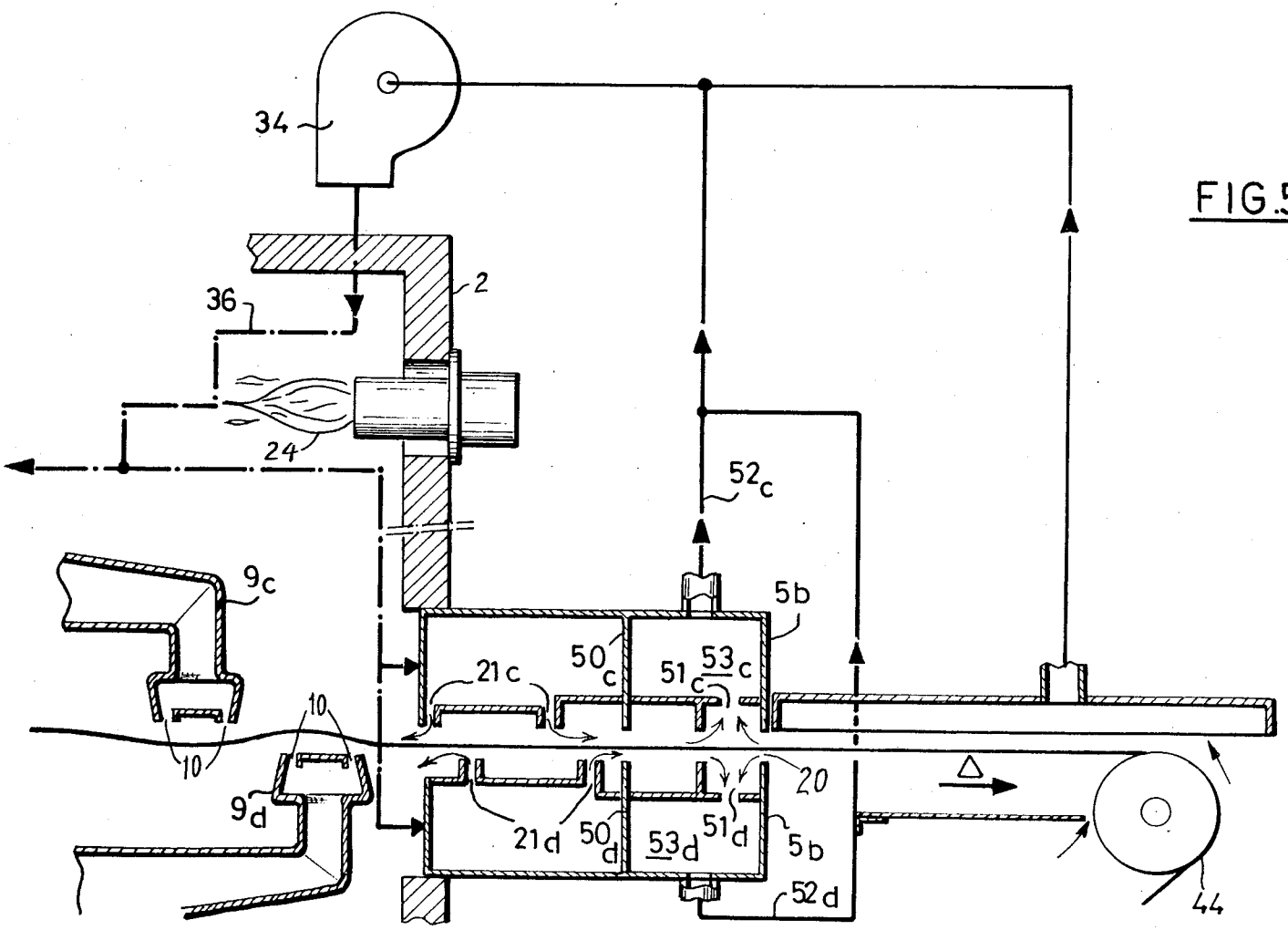
FIG. 5 is a second embodiment for the structure of FIG. 4 which permits a reduced exhaust air flow.

Referring next to the embodiment shown in FIG. 5, the nozzles are divided between two plenums by inner walls 50*c* and 50*d*, respectively, which walls are perpendicular to the direction D. The external plenums 53*c* and 53*d*, which are remote from the dryer envelope 2, are provided with openings 51*c* and 51*d* which communicate with the passage 20 on each surface of the web B. Plenums 53*c* and 53*d* are put under negative pressure by connecting them to the suction side of the fan or blower 34 through the ducts 52*c* and 52*d*, respectively. Thus, the external air flowing through the passages 20 and a part of the preheated air blown through the slits 21*c* and 21*d* are brought to the fan 34. In this way, the rate at which air enters the dryer envelope 2 is substantially reduced, for example, by about one-third. Moreover, since this air is exhausted at a high temperature, the reduction of air flow reduces fuel consumption of the heat source 24.

Figure 6:
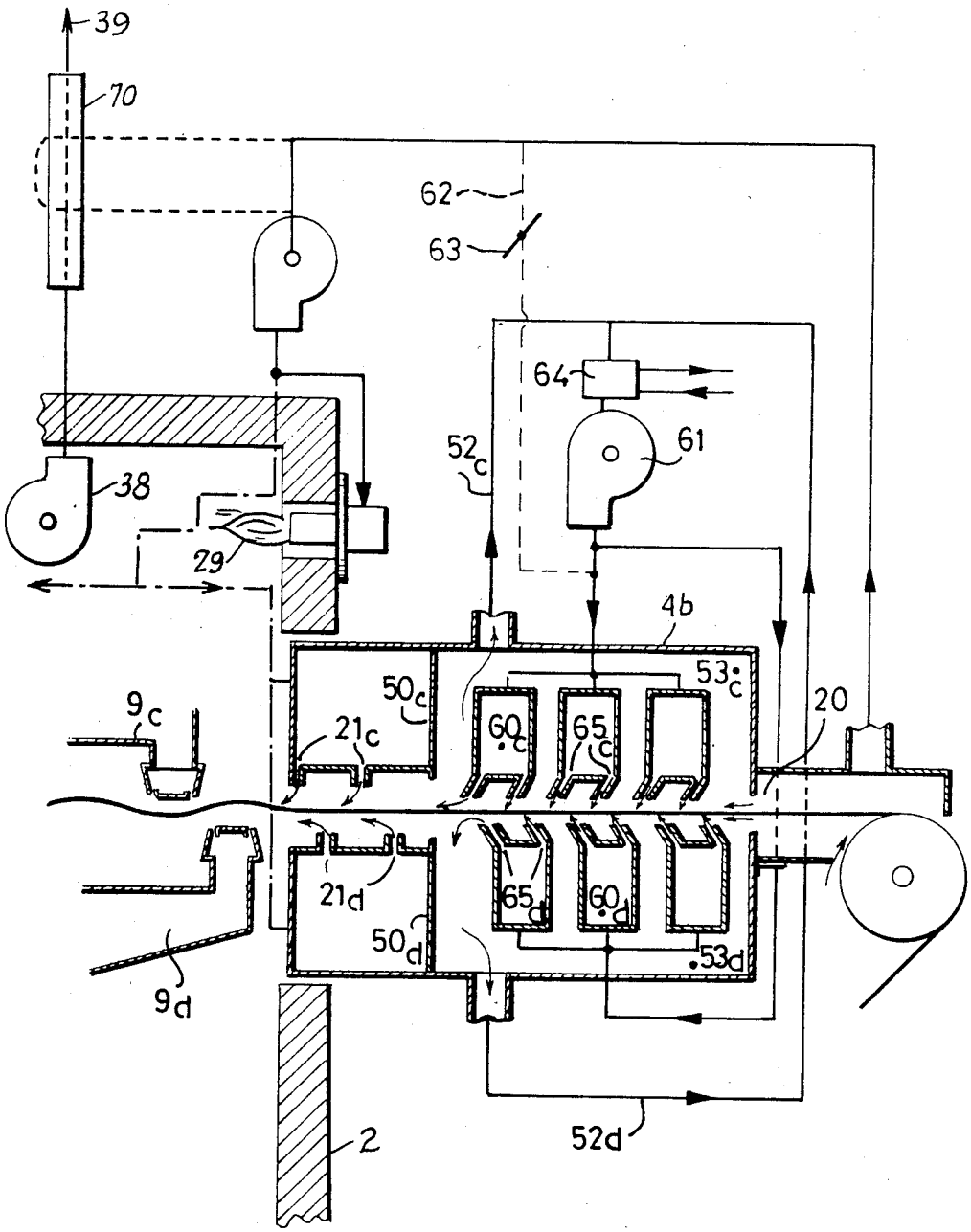
FIG. 6 is a third embodiment of the structure of FIGS. 4 and 5 which permits supplementary separation of the boundary layer.

A third embodiment, which is applicable to the outlet nozzles 4*b*, is shown in FIG. 6. FIG. 6 includes the same basic elements 21*c*, 21*d* together with the inner walls 50*c*, 50*d* of FIG. 5. The arrangement of FIG. 6 also includes nozzles 60*c* and 60*d* in plenums 53*c* and 53*d*, respectively, which are connected to the suction side of fan 61 by means of the ducts 52*c* and 52*d*, respectively. The pressure side of fan 61 is connected to the nozzles 60*c* and 60*d*. The ducts 52*c* and 52*d* may also be connected to the suction side of the fan 34 through a duct 62, as shown in dotted lines. The air flow through duct 62 is controlled by a flap valve 63. Upstream of the inlet of fan 61, the air coming from the plenums 53*c* and 53*d* flows through a heat exchanger 64, where it is cooled. The cooling agent may conveniently be the chilling water of the press line.

Each of the nozzles 60*c* and 60*d* is equipped with two slits 65*c* and 65*d*, respectively, which are slightly inclined towards the web and against the web direction D. That is, their free ends are directed backwards. The upper slits 65*c* are offset from the lower slits 65*d* so that the upper and lower slits are alternatively disposed along the web as are the air bars 9*c* and 9*d*.

The structure shown in FIG. 6 separates and removes the boundary layer of fluid formed on the paper web. Thus, despite the effect of the preheated air curtains by the slits 21*c* and 21*d*, a boundary layer is rapidly reformed and, due to the high web temperature, a part of the ink solvent evaporates, which leads to a high solvent vapor concentration in the boundary layer. The solvent concentration in the air recycled by the fan 61 is limitated by the condensation produced by the heat exchanger 64.

Returning to FIG. 2, each of the upper elements 7*b* of the two sections 5*a* and 5*b* contains recycling chambers 22*a* and 22*b*, respectively. Each of these chambers communicates with the outlet of blowers or recycling fans 23*a* and 23*b*, respectively, which are fixed under the upper side of the envelope 2. Therefore, the drive motor 24 of each fan is disposed above the envelope. The two sides of each of the chambers 22*a* or 22*b* are connected to vertical ducts 12*c* and 12*b* which open into the collectors 11*c* and 11*d*.

In the outlet wall 2*b* of the envelope, and in the region of the upper element 7*b*, a burner 24 is fixed which can be a burner operated by either gas or fuel oil. Within the envelope 2, the burner, which emits the flame 24*a*, is surrounded by a cylindrical combustion chamber 25, which extends from the burner to the front end of the blower chamber 22*a*. Combustion chamber 25 is coupled to hoods in chambers 22*a* and 22*b* which are directed downwards and communicates through passages 27 with the vertical ducts 12*c* and 12*d*. At the edges of the passages 27 are pivoted control flaps 28 which enable control of the mixing of the recycled air coming from the fan 23*a* or 23*b* and the burnt gas coming from the combustion chamber 25.

Figure 3:
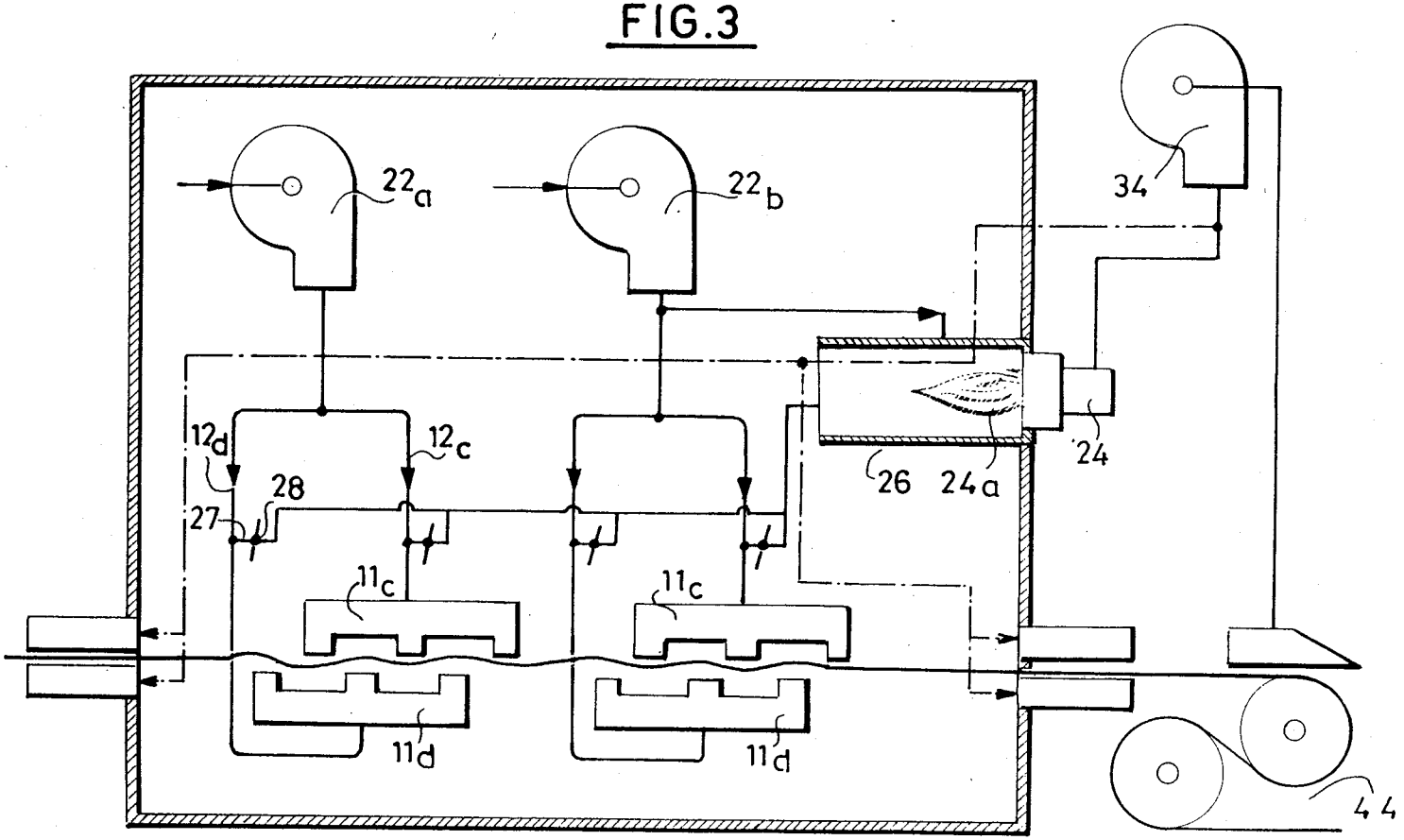
FIG. 3 schematically illustrates the air flow in the two module embodiment of FIG. 1.

In one embodiment of the invention, the control flaps 28 of the first section 5*a* are connected mechanically to a servo motor 29, which is connected electrically to a control device 30 which receives input signals from two temperature sensors 31*a* and 31*b* disposed respectively in the two upper collectors 11*c*. A control for the burner 24 is connected to and responds to signals from a second temperature sensor 32 disposed in the second section 5*b*, and to an infrared temperature detector 33 disposed downstream of the outlet unit 4*b*. The combustion air inlet of the burner 24 is connected to the output of a fan 34 which is fed from the hood of a cooler 44 (FIGS. 2 and 3). Cooler 44 is disposed downstream of the drying apparatus, and is disposed above the web B.

A second pipe 36, shown in phantom in FIG. 2, is connected to the supply of combustion air to burner 24. Pipe 36 enters the combustion chamber 26 in the region of chamber 22*b* and passes through chamber 25 to the other side so as to form a heat exchanger with this chamber. Pipe 36 then subdivides and is connected to the inlet (4*a*) and outlet (4*b*) units in both their upper and lower parts.

As shown in FIG. 2, the blower chamber 22*b* of the second section also communicates with a third duct 37 which is bent so as to envelope the combustion chamber 25 in the vicinity of the burner and to communicate with the air gap around the burner and thus supplies recycled air at this gap.

An exhaust fan 38 is then provided between the two lower chambers 22*a* and 22*b*. Fan 38 is fixed under the upper wall of the envelope 2 in a manner similar to the support of fans 23*a* and 3*b* and communicates with a chimney 39 venting to external air. A flap 40 is placed in chimney 39 to control the flow of exhaust air. A control device 41 for flap 40 receives first, a signal from a regulation device 42 which is responsive to the pressure drop within the envelope, and, second, a signal from a transducer 43 which is responsive to the solvent concentration within the envelope.

As shown more precisely in FIG. 7, the upper collector or plenum 11*c* has the shape of an elongated parallelopiped chamber with a wedge-shaped end. That is, the cross-section of the plenum in a vertical plane parallel to the direction of web movement D is a trapezoid. The air bars 9*c* are fixed underneath and across the whole width of this chamber 11*c*. Above chamber 11*c*, and across only a part of its width, is disposed the duct 12*c* which extends along the whole length of the upper face of the plenum 11*c*. At its upper end, duct 12*c* communicates with a conduit 22*a* which extends over the same length as the duct 12*c* in the direction D and projects transversely and in the direction of the air bars 9*c*. Recycling fan 23*a* is disposed in conduit 22*a*.

Within the blower duct 12 of FIG. 7 is disposed a vertical, transverse partition 44. Partition 44 is extended by a further partition 44*a* which also extends transversely over the width of the collector 11*c*, but is inclined. Two control flaps 28 and 28' are mounted in the duct 12*c* on opposite sides of partition 44 and pivot about a horizontal axis X—X, which is parallel to the direction of web movement D. Thus, two air currents pass on opposite sides of the partitions 44 and 44*a* to reach the group of air bars 9*c* positioned in front of the partitions 44*a* and to reach the group behind it.

It should be noted lastly that each section of the envelope can contain two envelope elements disposed above, below or beside one another and disposed transversely to the direction of web movement. One of these elements comprises the blower zone and the other the reheating zone. This provides great flexibility for installation in an available space on a press floor or to achieve any desired lateral extension of the apparatus. The reheating element of each section can be positioned remote from the blower element, in which case a third element establishes the connection between these two.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Apparatus for simultaneously drying in hot air a continuous web of flexible material carrying a solvent to be evaporated and supporting said continuous web of flexible material; said apparatus comprising:

a casing having a web inlet opening and a web outlet opening for said web, said web traveling between said inlet opening and said outlet opening in a general path (D) which extends longitudinally through the interior of said casing; said casing comprising at least two modular sections which contain respective chambers in adjacent relation longitudinally of said casing; each of said two sections having an upper set of nozzles and a lower set of nozzles disposed respectively above and below said general path; each of said two sections including air recycling means having input means communicating with said interior of said casing and output means; heater means; air exhaust means for extracting air from the interior of said casing; duct means coupled between said output means and said upper set of nozzles and said lower set of nozzles of the respective said section; conduit means for placing said heater means in communication with said duct means for preheating the air recycled to said sets of nozzles by said output means of said recycling means; and solvent concentration sensing means for sensing the concentration of said solvent in the atmosphere within said casing; said solvent concentration sensing means being connected to said air exhaust means for controlling said air exhaust means, and second pressure sensing means sensitive to the pressure difference between the inside and the outside of said casing; said second pressure sensing means connected to said air exhaust means for further controlling the flow through said exhaust means.

2. The apparatus of claim 1, wherein said heater means comprises at least one burner in a combustion chamber, said combustion chamber having an input connected to receive recycled air from at least one of said recycling means, said input of said combustion chamber being disposed upstream of said conduit means relative to the respective recycling means.

3. The apparatus of claim 1, wherein said heater means is a single heat supply means and said conduit means includes control means for controlling independently the heat supplied from said heater means to different ones of said sections thereby to control independently the air temperature at said nozzles of said different sections.

4. The apparatus of claim 3, wherein said control means includes means for controlling independently the heat supplied from said heater means to different groups of said nozzles in the same section.

5. The apparatus of claim 1, wherein said air exhaust means includes a fan disposed within said casing and motor means disposed exteriorly of said casing.

6. The apparatus of claim 1, wherein upper and lower external nozzle means are included and disposed outside of said casing and adjacent both of said web inlet and outlet openings, respectively, above and below said web path; said upper and lower external nozzle means having slits extending across the web path for blowing air onto said web, and means for heating and supplying external air to said external nozzle means exteriorly of said casing.

7. The apparatus of claim 6, wherein said slit means of said upper and lower external nozzle means consist of slit pairs spaced along the web path (D), the distance between said slits of said upper nozzles being offset from and overlapping the spaces between said lower slit pairs.

8. The apparatus of claim 6 which further includes fan means for supplying external air both to said heater means and to said means for heating external air.

9. The apparatus of claim 6, wherein said means for heating external air comprises heat exchange means which receives heat from said heater means.

10. The apparatus of claim 6, wherein said means for heating external air comprises means for recovering heat from the dried web issuing from the casing.

11. The apparatus of claim 10, wherein said means for recovering heat from said dried web includes cooler means for cooling said dried web.

12. The apparatus of claim 6, wherein said means for heating external air comprises means for recovering heat from the outlet of said air exhaust means.

13. The apparatus of claim 1, comprising longitudinal members carrying said nozzles; said longitudinal members forming tubes defining orifices for the passage of air which communicates with said nozzle; said tubes being open at their ends.

14. The apparatus of claim 6, which includes an inner wall disposed in said external nozzle means to divide the interior of said external nozzle means into two external plenums, means for placing the respective external plenum of each external nozzle means more distant from said casing under negative pressure, and openings in said plenums communicating with web path.

15. The apparatus of claim 14, wherein said external plenums are connected to said fan means.

16. The apparatus of claim 6, wherein at least two inner nozzles that are put in overpressure and provided with slits facing the web B are provided in each outlet nozzle means, the free end of said slits being directed backwards toward the direction of motion for the web.

17. The apparatus of claim 16, wherein said slits of said upper and lower outlet nozzle means are alternatively disposed along the web.

18. The apparatus of claim 16, wherein said inner nozzles are connected to fan means having a suction side connected to said external plenums of said outlet nozzle means.

19. The apparatus of claim 18, which further includes a heat exchanger connected upstream of said fan means.

20. The apparatus of claim 18, wherein said heat exchanger employs a cooling agent; said cooling agent comprising water.

21. The apparatus of claim 18, wherein said external plenums are connected to said fan means through a control flap.

22. Apparatus for simultaneously drying a continuous web of flexible material carrying a solvent to be evaporated in hot air and supporting said continuous web of flexible material; said apparatus comprising:

a casing having a web inlet opening and a web outlet opening for said web, said web traveling between said inlet opening and said outlet opening in a general path (D) which extends longitudinally through the interior of said casing; said casing comprising at least two modular sections which contain respective chambers in adjacent relations having an upper set of nozzles and a lower set of nozzles disposed respectively above and below said general path; each of said two sections including air recycling means having input means communicating with said interior of said casing and output means; heater means; air exhaust means for extracting air from the interior of said casing; duct means coupled between said output means and said upper set of nozzles and said lower set of nozzles of the respective said section; conduit means for placing said heater means in communication with said duct means for preheating the air recycled to said sets of nozzles by said output means of said recycling means; and upper and lower external nozzle means disposed outside of said casing and adjacent both of said web inlet and outlet openings, respectively, above and below said web path; said upper and lower external nozzle means having slits extending across the web path for blowing air onto said web, and means for heating and supplying external air to said external nozzle means exteriorly of said casing, said means comprising means for recovering heat from the dried web issuing from the casing.

23. The apparatus of claim 22, wherein said heater means comprises at least one burner in a combustion chamber, said combustion chamber having an input connected to receive recycled air from at least one of said recycling means, said input of said combustion chamber being disposed upstream of said conduit means relative to the respective recycling means.

24. The apparatus of claim 22, wherein said heater means is a single heat supply means and said conduit means includes control means for controlling independently the heat supplied from said heater means to different ones of said sections thereby to control independently the air temperature at said nozzles of said different sections.

25. The apparatus of claim 24, wherein said control means includes means for controlling independently the heat supplied from said heater means to different groups of said nozzles in the same section.

26. The apparatus of claim 22, wherein said air exhaust means includes a fan disposed within said casing and motor means disposed exteriorly of said casing.

27. The apparatus of claim 22, wherein said slit means of said upper and lower external nozzle means consist of slit pairs spaced along the web path (D), the distance between said slits of said upper nozzles being offset from and overlapping the spaces between said lower slit pairs.

28. The apparatus of claim 22, which further includes fan means for supplying external air both to said heater means and to said means for heating external air.

29. The apparatus of claim 22, wherein said means for heating external air comprises heat exchange means which receives heat from said heater means.

30. The apparatus of claim 22, wherein said means for recovering heat from said dried web includes cooler means for cooling said dried web.

31. The apparatus of claim 22, wherein said means for heating external air comprises means for recovering heat from the outlet of said air exhaust means.

32. The apparatus of claim 22, wherein said web carries a solvent to be evaporated by said apparatus; and solvent concentration sensing means for sensing the concentration of said solvent in the atmosphere within said casing; said solvent concentration sensing means being connected to said air exhaust means for controlling said air exhaust means, and second pressure sensing means sensitive to the pressure difference between the inside and the outside of said casing; said second pressure sensing means connected to said air exhaust means for further controlling the flow through said exhaust means.

33. The apparatus of claim 22, comprising longitudinal members carrying said nozzles; said longitudinal members forming tubes defining orifices for the passage of air which communicates with said nozzle; said tubes being open at their ends.

34. The apparatus of claim 22, which includes an inner wall disposed in said external nozzle means to divide the interior of said external nozzle means into two external plenums, means for placing the external plenum more distant from said casing of each external nozzle means under negative pressure, and openings in said plenums communicating with web path.

35. The apparatus of claim 34, wherein said external plenums are connected to said fan means.

36. The apparatus of claim 22, wherein at least two inner nozzles that are put in overpressure and provided with slits facing the web B are provided in each outlet nozzle means, the free end of said slits being directed backwards toward the direction of motion for the web.

37. The apparatus of claim 36, wherein said slits of said upper and lower outlet nozzle means are alternatively disposed along the web.

38. The apparatus of claim 36, wherein said inner nozzles are connected to fan means having a suction side connection to said external plenums of said outlet nozzle means.

39. The apparatus of claim 38, which further includes a heat exchanger connected upstream of said fan means.

40. The apparatus of claim 38, wherein said heat exchanger employs a cooling agent; said cooling agent comprising water.

41. The apparatus of claim 38, wherein said external plenums are connected to said fan means through a control flap.

* * * * *